US011436954B2

(12) United States Patent
Houlihan et al.

(10) Patent No.: US 11,436,954 B2
(45) Date of Patent: Sep. 6, 2022

(54) GRAPHIC DISPLAY MODULAR WALL SYSTEM

(71) Applicant: Brightformat, Inc., Grand Rapids, MI (US)

(72) Inventors: Peter M. Houlihan, Grand Rapids, MI (US); Michael P. Glupker, Wyoming, MI (US)

(73) Assignee: Brightformat, Inc., Grand Rapids, MI (US)

( * ) Notice: Subject to any disclaimer, the term of this patent is extended or adjusted under 35 U.S.C. 154(b) by 0 days.

(21) Appl. No.: 16/932,027

(22) Filed: Jul. 17, 2020

(65) Prior Publication Data

US 2021/0020080 A1 Jan. 21, 2021

Related U.S. Application Data

(60) Provisional application No. 62/875,560, filed on Jul. 18, 2019.

(51) Int. Cl.
*G09F 15/00* (2006.01)

(52) U.S. Cl.
CPC ..... *G09F 15/0068* (2013.01); *G09F 15/0012* (2013.01); *G09F 15/0018* (2013.01)

(58) Field of Classification Search
CPC .. A47G 1/065; A47G 2001/0672; A47G 5/00; A47F 5/112; B42D 15/008; B42D 15/042; G09F 1/06; G09F 1/065; G09F 15/0012; G09F 15/0018; G09F 15/0068; A47B 96/202; E04B 2/74; E04B 2/7425; E04B 2002/7468
USPC ..... 160/351, 352; 446/92, 129, 137, 139; 52/631, DIG. 4
See application file for complete search history.

(56) References Cited

U.S. PATENT DOCUMENTS 3,654,053 A * 4/1972 Toedter ..... B32B 3/14 428/56
4,028,855 A * 6/1977 Prewer ..... E04B 1/6108 52/272
5,903,992 A * 5/1999 Eisenberg ..... G09F 1/12 40/738

(Continued)

*Primary Examiner* — Cassandra Davis
(74) *Attorney, Agent, or Firm* — Warner Norcross + Judd LLP

(57) ABSTRACT

A display panel for an upright display system includes a substrate having a front surface, a rear surface, an upper edge, a lower edge and a pair of opposing side edges. The substrate includes first and second cutouts in the rear surface, the cutouts extending from the upper edge to the lower edge to form a pair of hinges in the substrate. The cutouts dividing the substrate into a main substrate portion adjacent the second cutout, an intermediate portion between the cutouts, and a fold portion extending from the first cutout to a side edge of the substrate. The substrate is folded about the hinges such that the rear surface of the fold portion abuts the rear surface of the main portion. An adhesive is positioned between the rear surface of the fold portion and the rear surface of the main portion; and at least one magnet is disposed on the front surface of the substrate and capable of aligning and attracting an associated magnet on another of the substrates to form interconnected walls of the upright display system.

10 Claims, 12 Drawing Sheets

(56) References Cited

U.S. PATENT DOCUMENTS

| | | | | |
|---|---|---|---|---|
| 8,141,316 | B2 * | 3/2012 | Remin | E04B 9/06 52/631 |
| 2012/0156402 | A1 * | 6/2012 | Domanski | B41M 5/502 428/32.18 |
| 2015/0231521 | A1 * | 8/2015 | Peterson | A63H 33/046 446/92 |
| 2018/0368590 | A1 * | 12/2018 | Yadgard | A47G 1/065 |
| 2019/0114135 | A1 * | 4/2019 | Childs | G06F 3/1446 |
| 2019/0254444 | A1 * | 8/2019 | Boogert | G09F 15/0062 |

* cited by examiner

GRAPHIC DISPLAY MODULAR WALL SYSTEM

BACKGROUND OF THE INVENTION

The present invention relates to modular wall systems, such as those generally used to display graphics or artwork, provide information, or create architectural spaces at corporate events, trade shows, conferences, weddings, fundraisers or any event requiring or benefiting from visible information.

Typical graphic display systems require a labor intensive set up and take down. These systems are often not permanent and form standalone walls or a series of walls without the benefit of support from other permanent walls or structures. In many cases, a construction team or set up team must arrive on scene well prior to the event or show in question with sufficient tools and equipment to stand up and fasten together a series of adjacent panels containing the printed information to be displayed for the particular event, and a team must return at the end of the event to take the system down. This labor and tine can be costly, especially when the same system must travel and be set up ad multiple locations.

In addition to the costly labor of setup and take down, traditional systems often include some unsightly aspects. Traditional graphic displays include a foam backed panel with front and rear surfaces on the foam backer that are capable of containing printed information, but side edges that are not. The unprinted side edges are unsightly, and create discontinuities in the graphics printed on the front surfaces when two or more adjacent panels are arranged together.

Business owners today are constantly striving for efficiencies in processes and reduction in labor costs and simultaneously for seamless professional appearance in graphic materials—even in temporary spaces.

SUMMARY OF THE INVENTION

The present invention provides a display panel for simply and efficiently constructing an upright display system. In one embodiment, the display panel includes a substrate having a front surface, a rear surface, an upper edge, a lower edge and a pair of opposing side edges. The substrate includes first and second cutouts in the rear surface, the cutouts extending from the upper edge to the lower edge to form a pair of hinges in the substrate. The cutouts divide the substrate into a main substrate portion adjacent the second cutout, an intermediate portion between the cutouts, and a fold portion extending from the first cutout to a side edge of the substrate. The substrate is folded about the hinges such that the rear surface of the fold portion abuts the rear surface of the main portion. In one embodiment, an adhesive is placed between the rear surface of the fold portion and the rear surface of the main portion; and at least one magnet is disposed on the front surface of the substrate and the magnet is capable of aligning and attracting an associated magnet on another of the substrates to form the upright display system. Additional substrates may be similarly magnetically connected to the substrates to form a box-like configuration for the upright display system, wherein any printed graphic materials on the front surfaces of the substrates can be aligned to extend across multiple substrates without seeing the unsightly, unprinted side edges of the substrate.

In one embodiment, the magnet is disposed on the front surface of one of the fold portion and the intermediate portion. Multiple such magnets may be spaced apart in vertical alignment along the one of the fold portion and the intermediate portion. In another embodiment, an auxiliary magnet is disposed on the other of the fold portion and the intermediate portion for connecting a first upright display system to a second upright display system.

In another embodiment, the V-shaped channels are specifically configured for the thickness of the substrate. For example, the points of the respective V-shaped channels may be spaced apart at about twice the thickness of the panel. In this way, the fold portion rests flush against the main portion when the substrate is in the folded position.

The present invention also includes a method for constructing an upright display system, including the steps of: providing a first substrate having a front surface, a rear surface, a top edge, a bottom edge and a side edge, the front surface including a desired printed graphic material; forming two V-shaped channels into the rear surface the substrate to create parallel hinges in the substrate, the hinges defining a main substrate portion on a first side of the hinges, an intermediate portion between the hinges, and a fold portion on a second side of the hinges and including the side edge; forming a magnet channel in the front surface of the substrate within one of the fold portion and the intermediate portion; inserting a magnet into the magnet channel to sit flush with the front surface of the substrate; applying an adhesive to the rear surface of one of the fold portion and the main portion; folding the substrate about the hinges such that the fold portion lies flat against the main panel with the adhesive in between; providing a second one of the substrates; the second substrate defining the magnet channel and magnet on the other of the fold portion and the intermediate portion; standing the first and second substrates on a ground surface with the bottom edges of the substrates facing the ground surface; aligning the magnet of the first substrate with the magnet of the second substrate, the first substrate extending at an angle with respect to the second substrate; and connecting the standing first and second substrates to one another via the magnets.

In one embodiment, the substrates with magnets on the fold portion are main panels and the substrates with magnets on the intermediate portion are endcap panels. Two opposing main panels may be connected to two opposing endcap panels to form a box-like upright display system with four external graphic display surfaces. In a further embodiment, multiple box-like upright display structures may be connected to one another using the auxiliary magnets.

These and other objects, advantages, and features of the invention will be more fully understood and appreciated by reference to the description of the current embodiment and the drawings.

Figure 1:
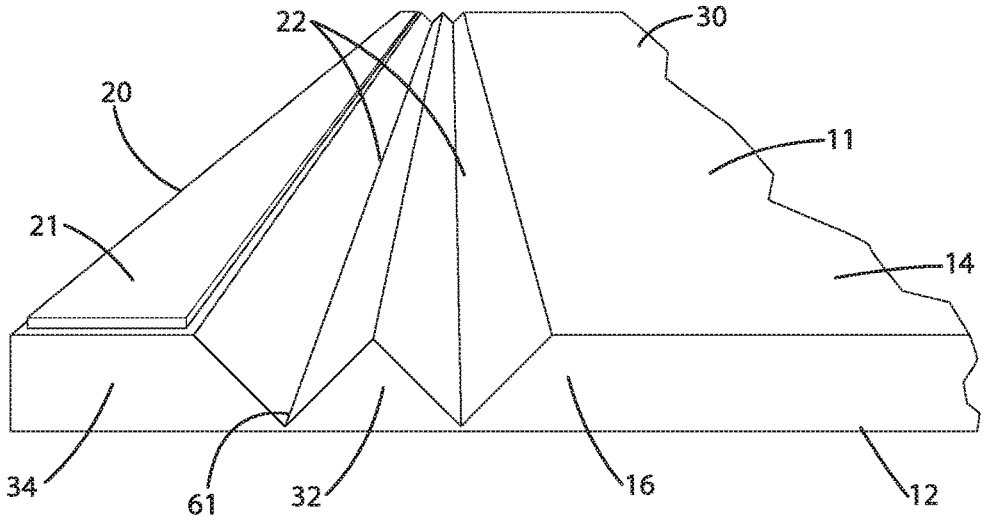
FIG. 1 is a close up end view of a panel according to one embodiment.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A graphic wall display system according to one embodiment of the current invention is shown in the Figs. and generally designated 10. As described herein, the system 10 provides a freestanding graphic display including a series of panels 11 that can be simply and efficiently set up and taken down without the need for additional tools, for use in a variety of temporary or long term settings such as trade shows, marketing, promotional and descriptive displays.

1. Structure

With reference to FIGS. 1-24, the present invention generally includes a freestanding system 10 of two or more panels 11 that are connected together to form a freestanding structure. Each panel 11 generally includes front 12 and rear 14 panel surfaces, a top edge 16, a bottom edge 18 and side edges 20. The front surface 12 generally includes graphic material 25 (such as a combination of printed or otherwise applied text and images as shown in FIGS. 22-24)) extending over all or a portion of the surface 12. In one embodiment, panels 11 include face panels 23 and end caps 24. Face panels 23 may be connected directly to one another, and in another embodiment, face panels 23 may be connected to each other by endcaps 24 that are configured to attach to the face panels 23 at a right angle (such as the configuration shown in FIGS. 19-24). The front face 12 of a face panel 23 or an endcap 24 may include the graphic material.

Figure 3:
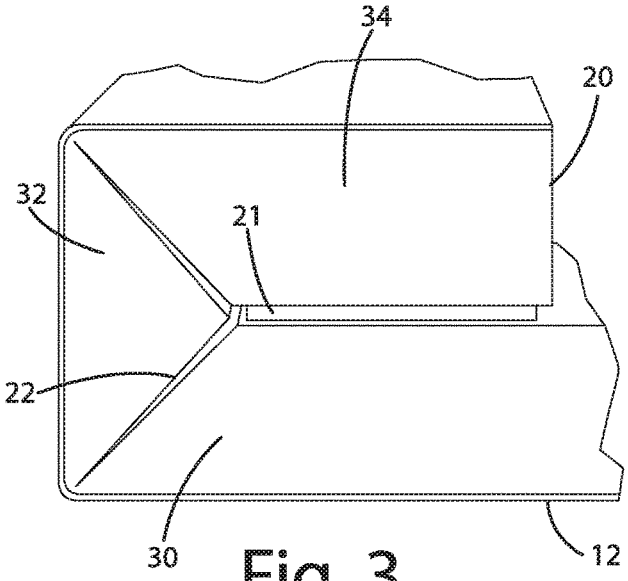
FIG. 3 is a close up end view of the panel.
Figure 4:
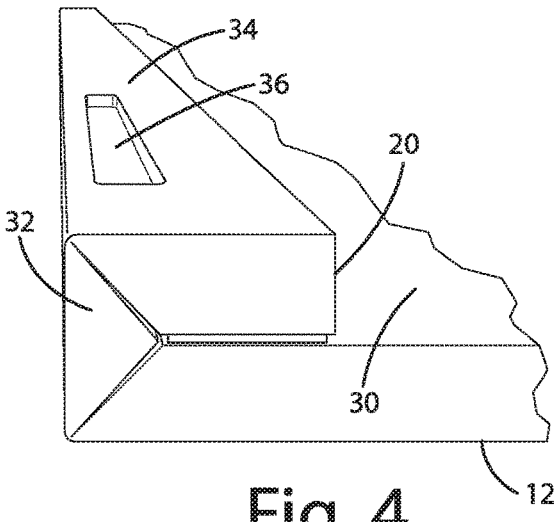
FIG. 4 is a close up end view of a panel and magnet.

In one embodiment, shown in FIG. 1, the rear panel surface 14 includes two V-channel cuts 22. The V-channel cuts are disposed in the rear surface 14 of the panel and extend from the top edge 16 to the lower edge 18 to form a pair of flexible hinges in the material that allow the material to be folded over on itself in varying thicknesses, as shown in FIGS. 3 and 4. The V-channel cuts 22 divide the panel 10 into a main panel portion 30, a triangular portion 32 and a fold portion 34. As shown in FIG. 3, the fold portion 34 can be folded back onto the main panel portion 30. This allows for a seamless finish as the printed image on the front surface 12 conceals the otherwise exposed side edge 20 and allows graphics to be continuous along multiple face panels 23 and endcaps 24. An adhesive 21, such as a strip of double-sided tape, may be applied to the rear surface 14 of the fold portion 34 to secure the fold portion 34 to the main panel portion 30 when in the folded position.

Figure 2:
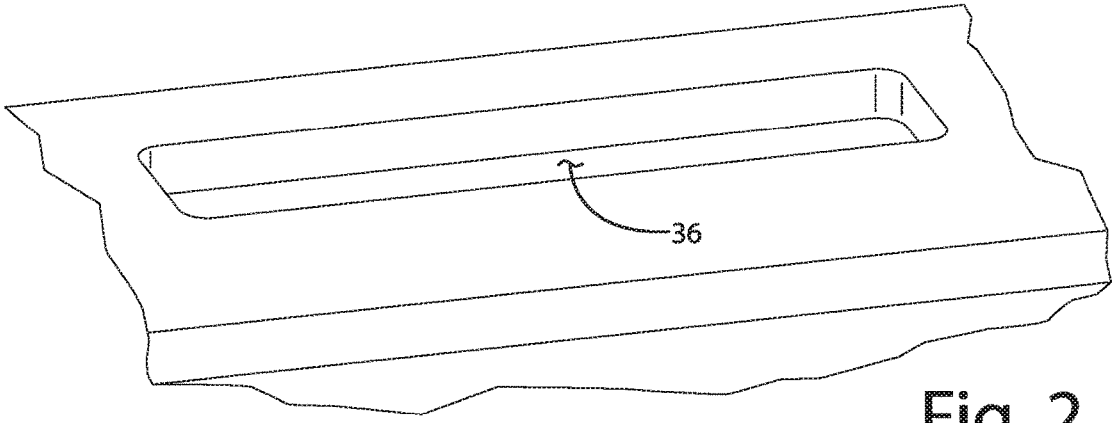
FIG. 2 is a close up view of a magnet channel.
Figure 5:
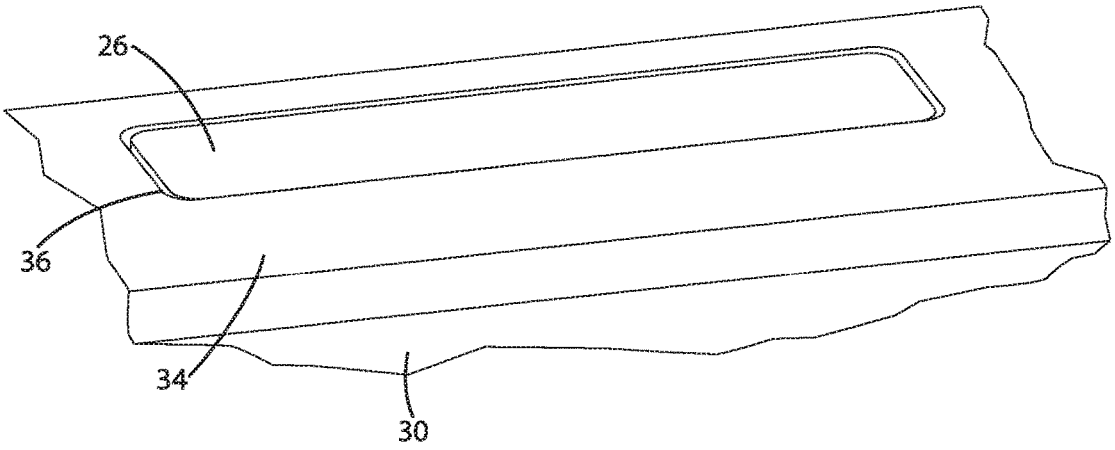
FIG. 5 is a close up view of a magnet.

In one embodiment, magnets 26 are embedded into the panels 11, which allow the panels 11 to click together in alignment with one another without the need for any additional tools or any need for previous graphic installation experience. As shown in FIGS. 2 and 4, in one embodiment, a face panel 23 includes one or more magnet cutouts, or channels 36 defined in the front surface 12 of the fold portion 34. As shown in FIG. 5, magnets 26 may be inserted into the magnet channels 36. A series of magnets 26 may be spaced apart along the length of a panel 11. In one embodiment, the position of the magnets 26 is registered to the position of any printed graphics such that the graphics of a panel 11 align in a desired manner with the graphics of another panel 11 when the panels are connected as described in more detail below.

Referring to FIGS. 19-24, endcaps 24 may include magnet channels 36 and magnets 26 disposed on the front surface 12 of the triangular panel portion 32. These endcap magnets 26 may be spaced along the length of an endcap 24 at the same spacing as the magnets 26 of an associated fold portion 34 of a face panel 23, with opposite polarities of the magnets 26 of the associated face panel 23, such that the magnets 26 of the endcap 24 attract and snap together with magnets 26 of the associated face panel 23 at a right angle only when the endcap 23 and associated panel 24—and any graphics on the endcap 24 and panel 23—are correctly aligned.

In another embodiment where additional strength is desired in the connection between panels 11, an adhesive 28 is applied over the magnets 26 so that once the magnets 26 draw the panels 11 together in alignment, the adhesive 28 makes the bond both more durable and permanent. In the illustrated embodiment shown in FIG. 6, the adhesive 28 is an adhesive tape, although other forms of adhesive may otherwise be used.

Figure 16:
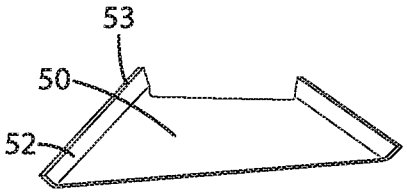
FIG. 16 is a perspective view of a corner brace.
Figure 17:
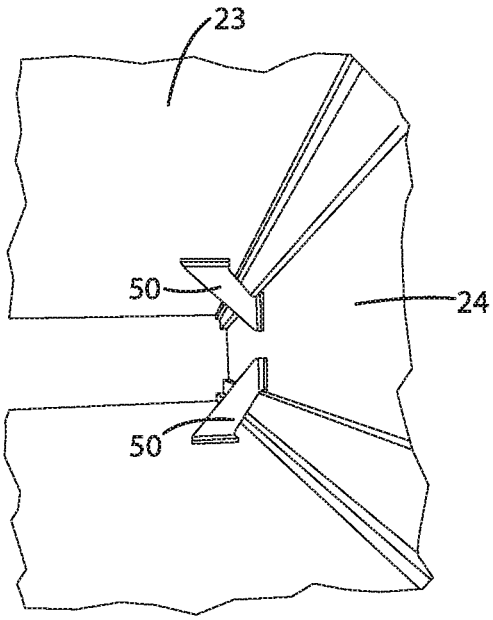
FIG. 17 is a close up view of an upright display system with corner braces.
Figure 18:
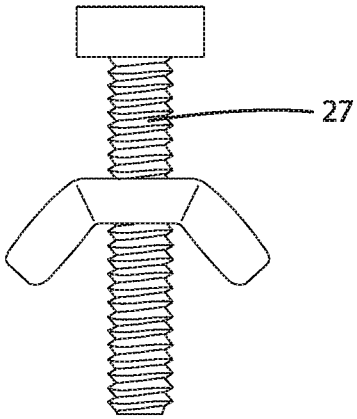
FIG. 18 is a top view of a fastener.
Figure 19:
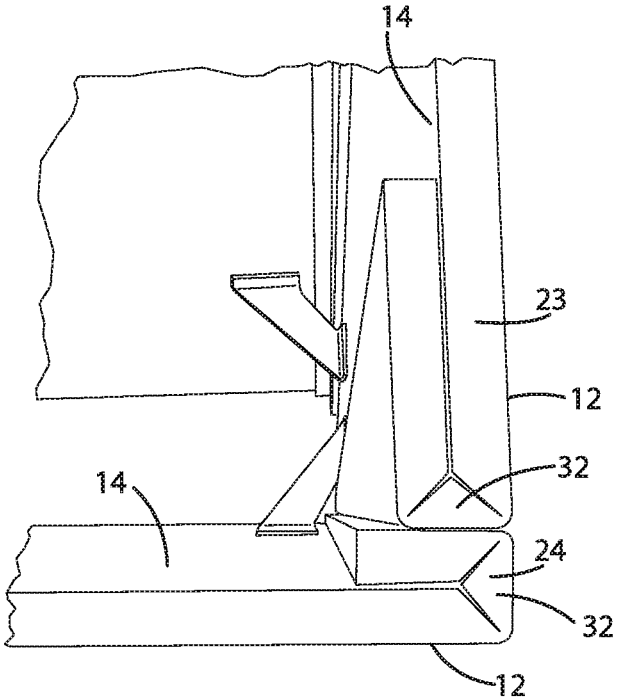
FIG. 19 is a top view of two interconnected panels with corner braces.

Optionally, custom corner braces 50 are included to stabilize the free standing system 10. As shown in FIGS. 16 and 17, the braces 50 may include flanges 52 with an adhesive 53 such as double-sided adhesive tape so that stability can easily be improved on-site without any tools or any previous experience. This arrangement may be particularly helpful in high-traffic areas.

Each wall system is self-supported and stands on its own. No stakes, ties, or separate stands need to be used. The system 10 does not require that the panels 11 attach to an internal frame. The panels 11 are manufactured to attach to themselves or to endcaps 23, there are no separate bases required to enable the walls to stand on their own.

Figure 13:
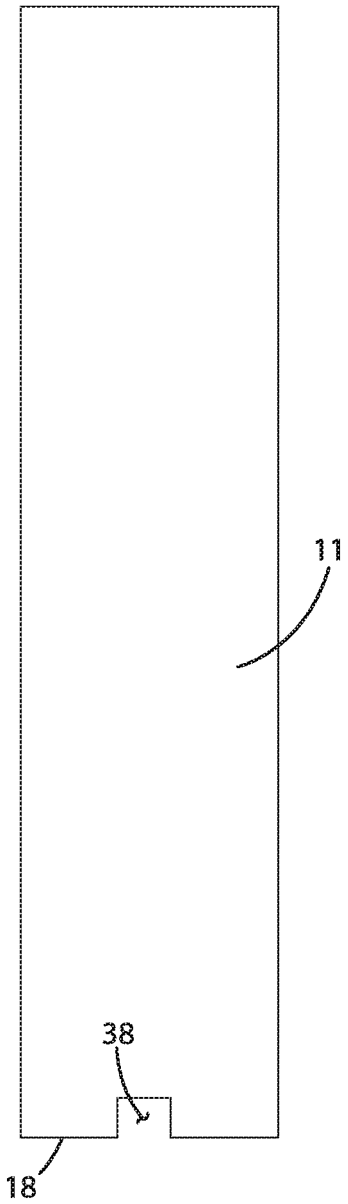
FIG. 13 is a side view of a panel with an electrical cutout.
Figure 14:
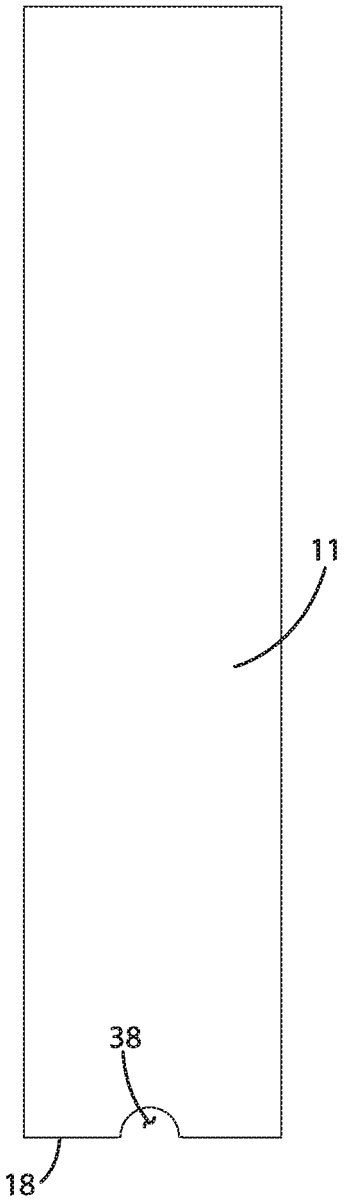
FIG. 14 is a side view of a panel with an alternative electrical cutout.
Figure 15:
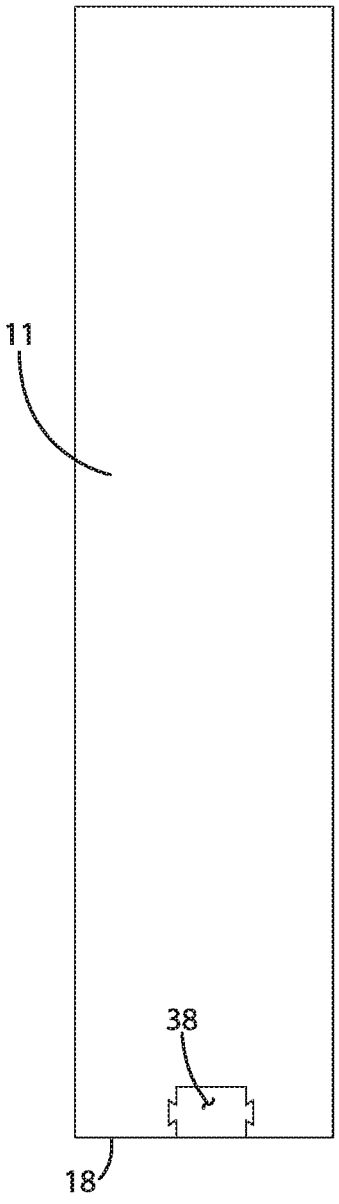
FIG. 15 is a side view of a panel with an alternative electrical cutout.

In one embodiment, computer monitors, or other separate electronic or analog displays can be mounted to the panels 11 (or endcaps 24). As shown in FIGS. 13-15, the panels may optionally include permanent or removable cutouts 38 on the bottom edges 18 of the panels 11, either faces 23 or endcaps 24, so that power can be run underneath and through the wall system 10. More particularly, FIG. 13 shows a square shaped opening 38, FIG. 14 shows a semi-circular shaped opening 38, and FIG. 15 shows a dog-ear shaped opening 38.

Figure 7:
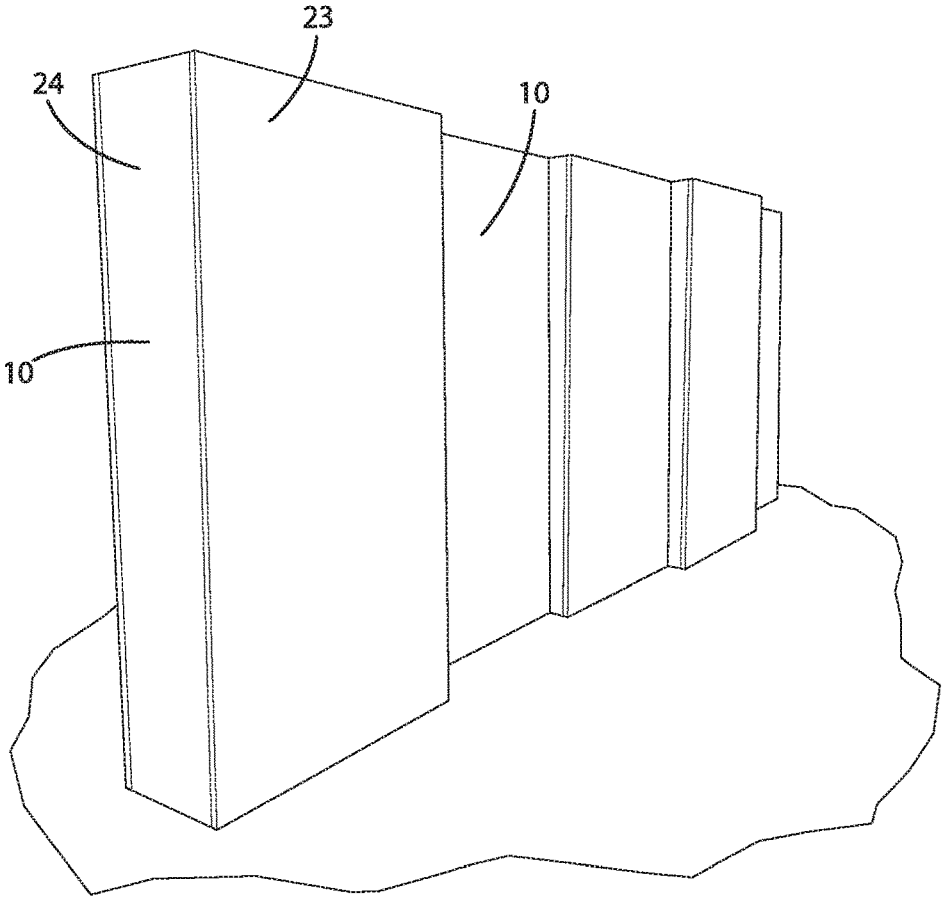
FIG. 7 is a perspective view of a series of interconnected upright display systems.
Figure 8:
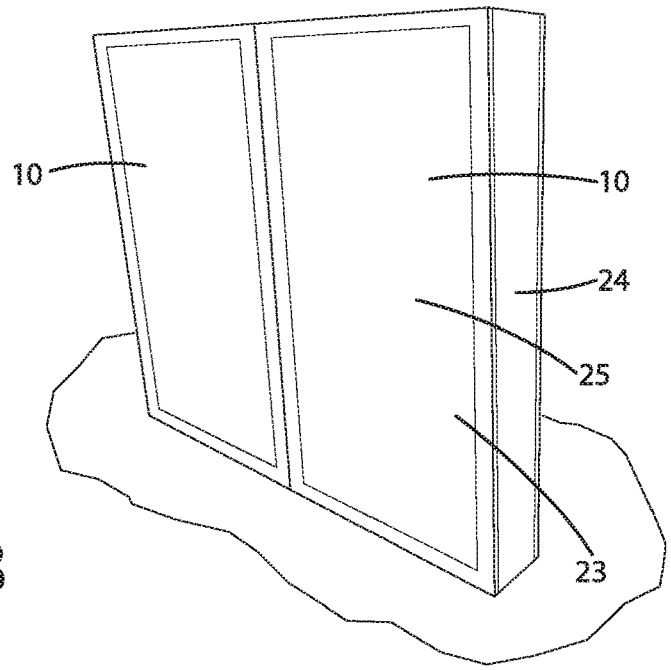
FIG. 8 is a perspective view of two interconnected upright display systems.
Figure 9:
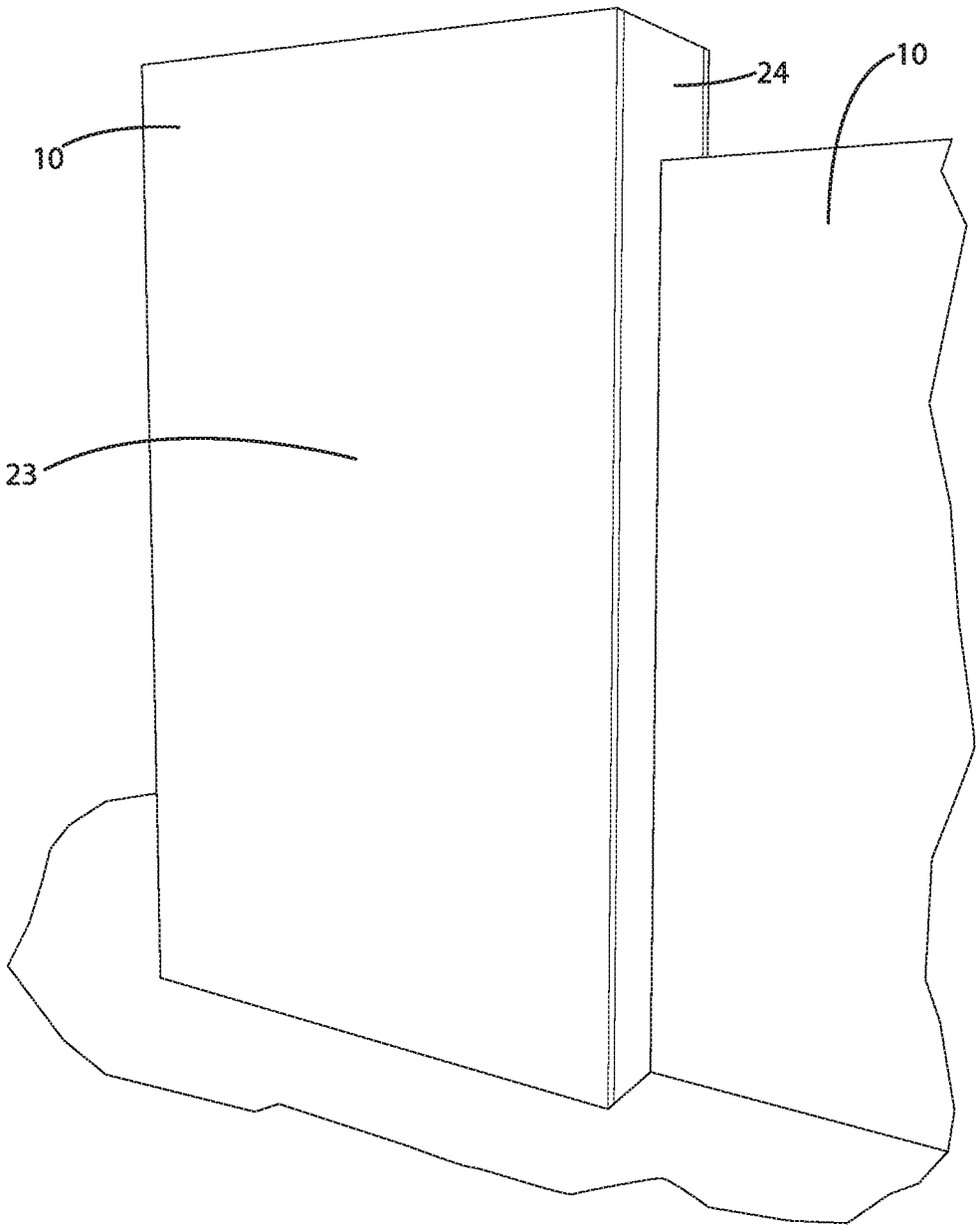
FIG. 9 is a perspective view of two interconnected upright display systems.
Figure 10:
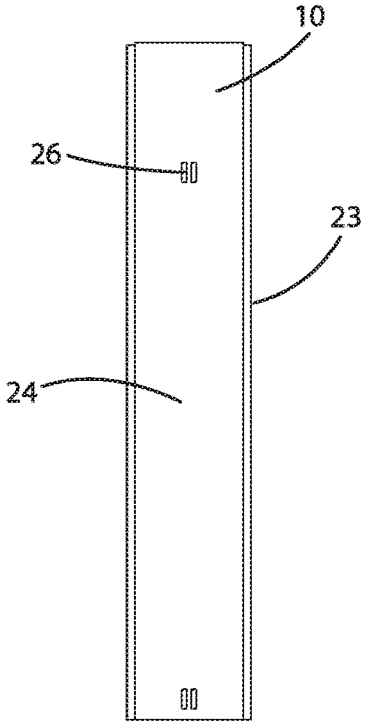
FIG. 10 is a side view of an upright display system.
Figure 11:
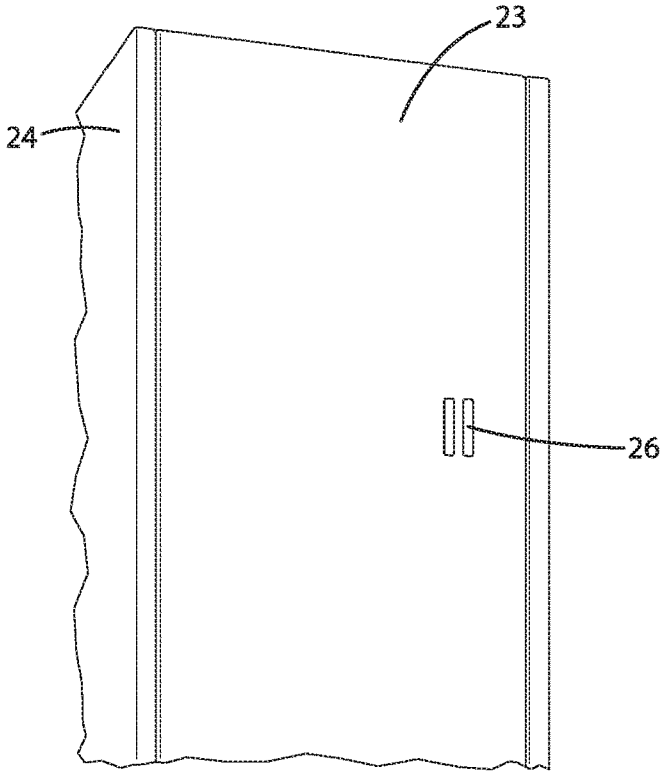
FIG. 11 is a close up view of a portion of an upright display system.
Figure 12:
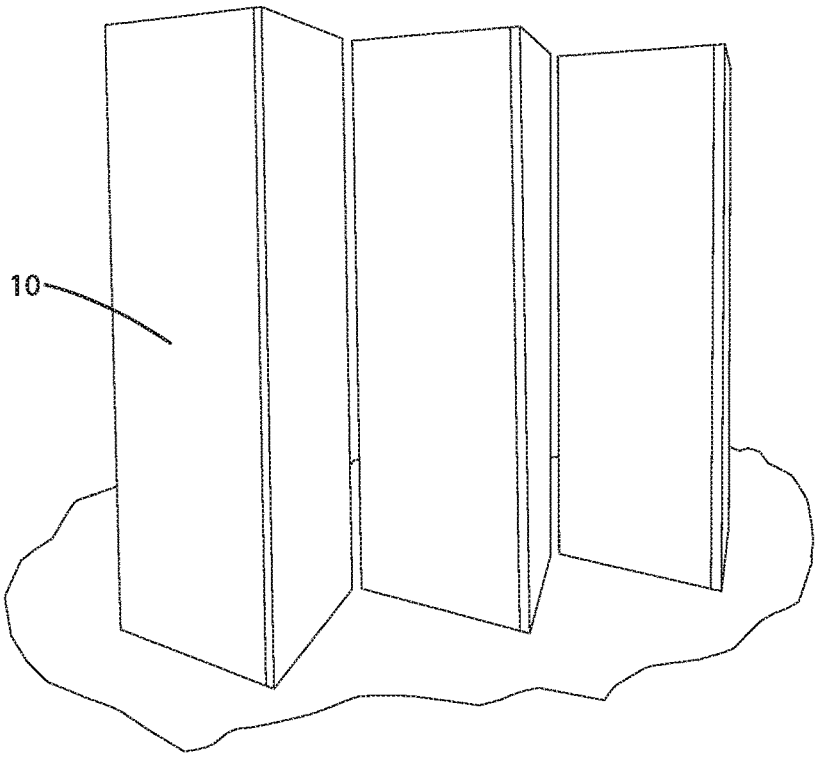
FIG. 12 is a perspective view of a series of interconnected upright display systems.

The panels 11 can be created in various sizes, and panels 11 can easily be attached to other panels 11, and to other freestanding panel systems 10, using the combination of magnets 26 and adhesive 28. As shown in FIG. 8, panel systems 10 of identical size can be attached together, each with a pair of face panels 23 and a pair of endcaps 23. Endcaps for connecting the first system 10 to the second system 10 may include magnets 26 on the exterior surfaces for connecting the systems 10 together (as shown in FIGS. 10 and 11). Alternatively the system shown in FIG. 8 may include a single endcap joined between the first 10 and second 10 systems. As shown in FIGS. 7 and 9, panel systems 10 of different sizes can be attached together. In this embodiment, each system 10 may be identical, with each including opposing pairs of face panels 23 and end caps 24. Again, the inner endcaps 24 of each system 10 may each include an exterior set of magnets 26 (see FIGS. 10 and 11) for connecting to aligned magnets 26 on the adjacent system 10. As shown in FIGS. 10 and 11, in an embodiment where two or more panel systems 10 are attached together, magnets 26 may be positioned on the front surface 12 of an endcap 24 (or, alternatively, a face panel 23) in alignment with associated magnets 26 on an adjacent panel system 10 for attachment of the panel systems 10 to one another. In the embodiment illustrated in FIGS. 10 and 11, sets of parallel, dual auxiliary magnets 26 are positioned at spaced apart heights on the front surface 12 of adjacent endcaps 24 (FIG. 10) or face panels 23 (FIG. 11). In addition, a hole may be drilled near each dual magnet grouping so that thumbscrews 27 can be used to hold the panels together. This can be used when the floor is not level to tightly hold panels together.

The panels 11 may be designed to support interactive elements. For example, the panels 11 may be provided with a surface that can be written on with markers, and they may otherwise be provided with a chalkboard vinyl, dry-erase lamination, or other specialty films applied that would allow for a person to write-on and interact with the panel 11.

2. Manufacture and Assembly

Manufacture and installation of the wall panel system 10, or a series of systems 10, involves a series of construction and assembly steps. In a first step, with reference to FIG. 1, two V-channels 22 are cut into the rear surface 14 of the generally flat panel material, which may be made from a variety of materials including polystyrene. As shown, the channels are cut at 90 degree angles and are oriented at 45 degrees with respect to each other such that the point 61 of each V-channel extends almost entirely to the front surface 12. In one embodiment, the panel thickness is 1.15" and the points 61 of the channels 22 are exactly 0.575" apart (about twice the panel thickness), which allows for the material to be folded back on itself at 180 degrees with the rear surface 14 of the fold portion 34 abutting flush with the rear surface 14 of the portion 30. These channels 22 may otherwise have different spacing depending on the thickness of panel material being used and the specific application of the panels 11. In one embodiment, different angles of cutting can also be used if the fold should be less than 180 degrees. For example, a triangular column such as that shown in FIG. 12 would have panels channeled at 30 degree angles each.

In a second step, shown in FIG. 2, the panel material is turned over and channels 36 for the magnets 26 are routed out of the material such that the magnets 26 can be inserted into the channels 36 to sit flush with the front surface 12 of the panel 11. In the embodiment shown in FIGS. 3 and 4, the magnet channels 36 are positioned on the front surface 12 of the fold portion 34 of a face panel 23. In the case of an endcap 24, the magnet channels 36 may be positioned on the front surface 12 of the triangular portion 32. In the illustrated embodiment, the magnets are 2" long by 0.25" wide, but magnets 26 of varying size, strength, and shape can be used depending on the application. At the same time, the final perimeter size of the panel is cut out of the master sheet. The magnets may be adhered to the panel 11 using hot glue, double-sided tape, or foam adhesive tape.

In a third step, shown in FIGS. 3 and 4, an adhesive 21 such as a double-stick tape is applied to the rear surface 14 of the fold portion 34 (or the main panel 30) and the end of the panel is folded over such that the fold portion 34 lies flat against the main panel 30 with the adhesive in between. This allows for any printing and graphics on the front surface 12 to continue across panels and does not leave an unsightly exposed edge. In other words, the side edges 20 of the panels 11 are folded inwardly and hidden. Any printed material on the front surface 12 may extend to the edge of the main panel 30, or along the front surface 12 of the triangular panel 32 and fold panel 34 depending on the final configuration of the system 10. In general, foam material such as that used for the panels 11 and generally used in the graphic arts has two printable surfaces, one on the front 12 and one on the back 14, but the edges 20 are exposed foam which cannot be printed. The present method of production allows for those edges 20 to be folded inwardly with only the printed front surface 12 exposed without any separate panels or materials needed.

Figure 6:
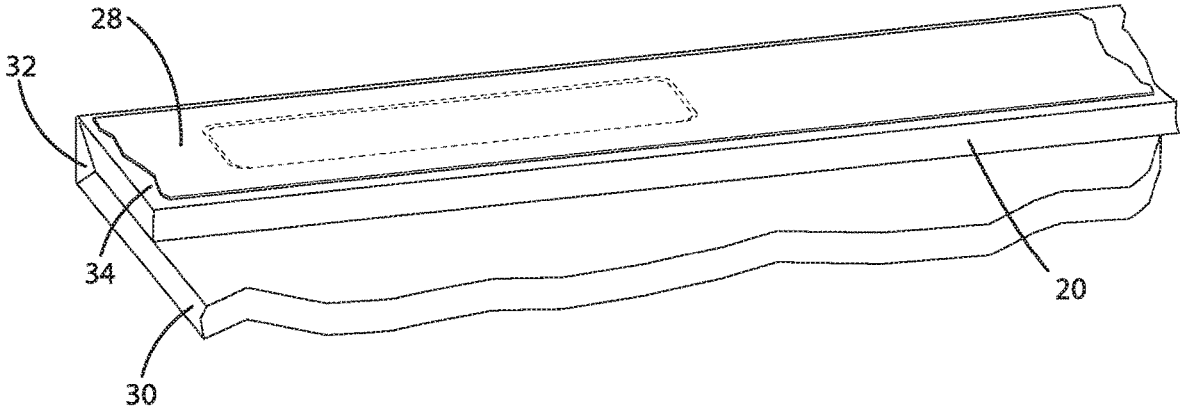
FIG. 6 is a close up view of the magnet and adhesive.

A fourth manufacturing step is shown in FIGS. 5 and 6. As shown in FIG. 5, the magnet 26 is set in the magnet channel 36. A strip of adhesive 28, such as adhesive tape 28, is applied over the top of the magnets 26 (or adjacent to the magnets) on the front surface 12 of the fold portion 34 of the panel 11. At this point in the process, the panel is complete and ready to be installed or packaged for shipping.

Figure 20:
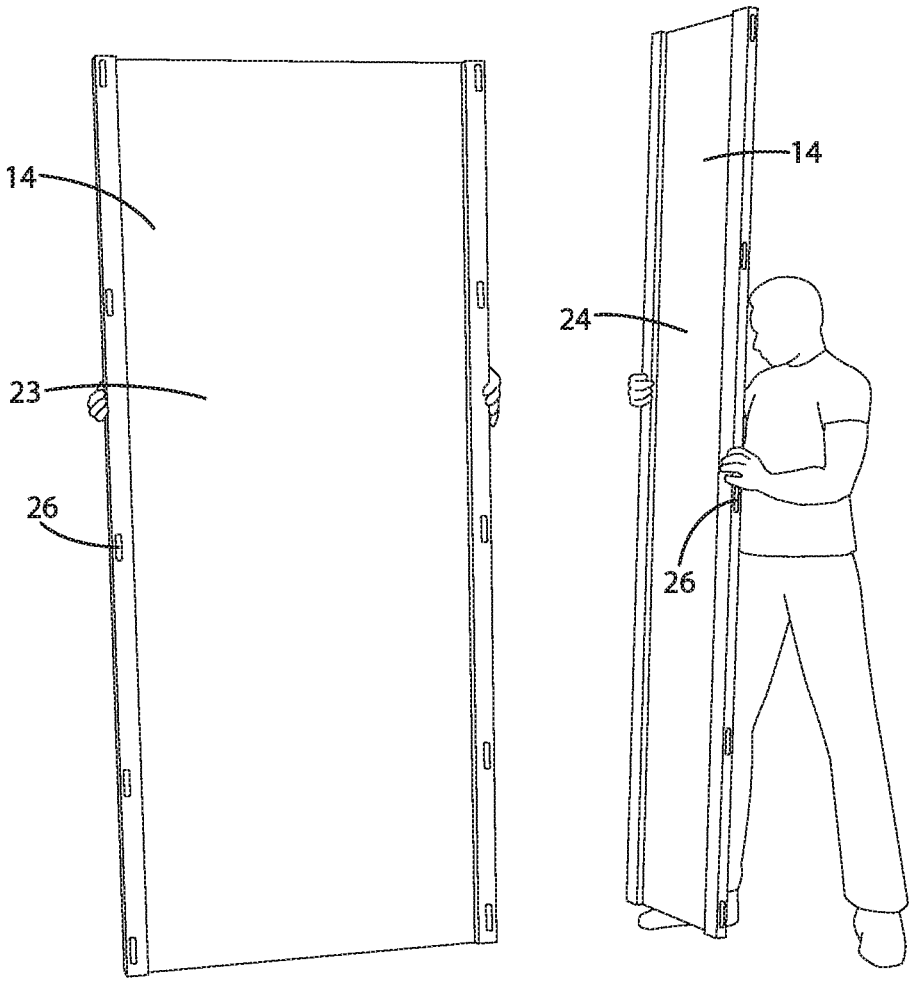
FIG. 20 is a perspective view of two panels of the upright display system prior to interconnection of the panels.
Figure 21:
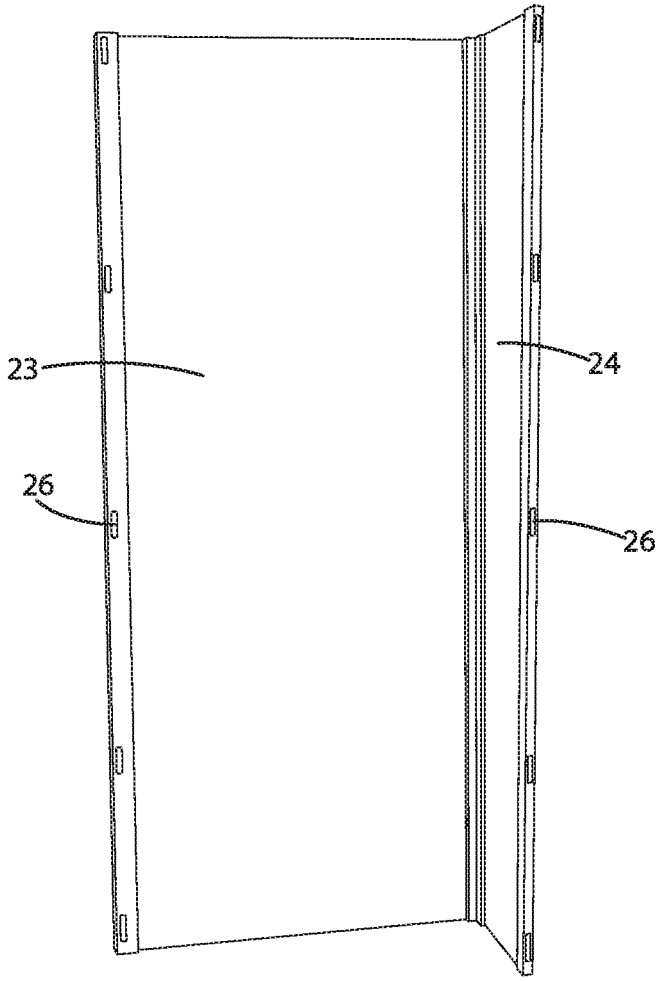
FIG. 21 is a perspective view of two panels of the upright display system after interconnection of the panels.
Figure 22:
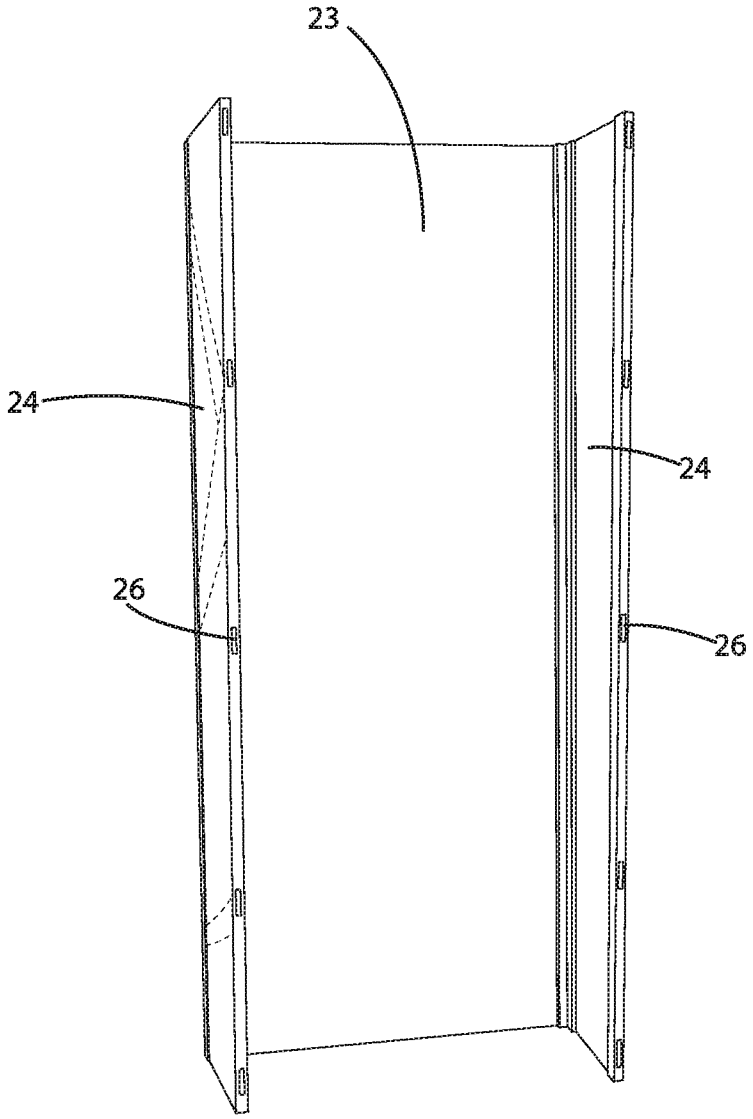
FIG. 22 is a perspective view of three interconnected panels.
Figure 23:
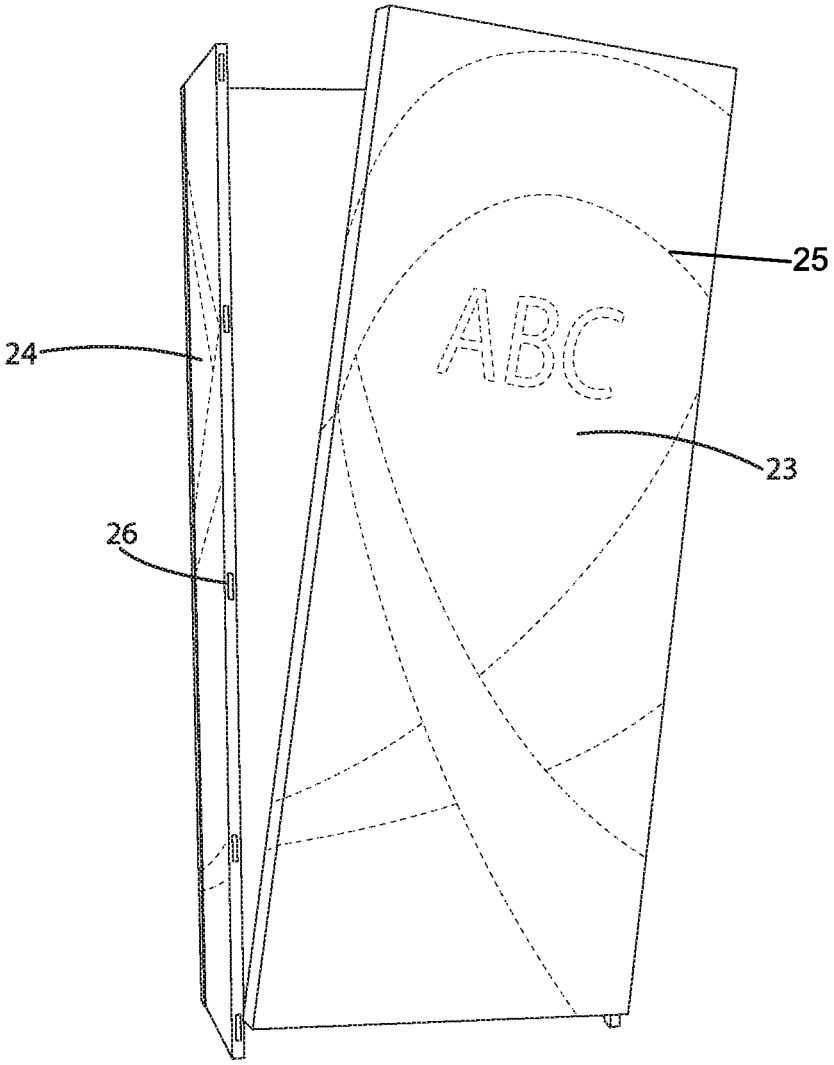
FIG. 23 is a perspective view of four panels prior to connection of the fourth panel.
Figure 24:
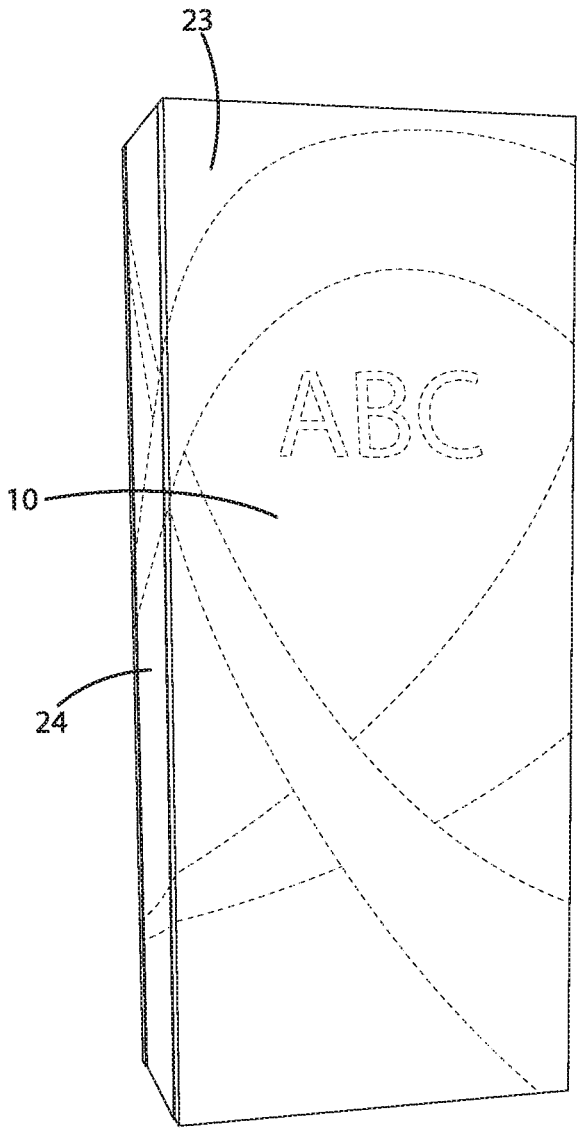
FIG. 24 is a perspective view of an assembled upright display system.

The steps of assembling a freestanding panel system 10 that includes two opposing face panels 23 and two endcaps 24 are shown in FIGS. 20-24. Referring to FIG. 20, a first step includes positioning one side of a face panel 23 adjacent one side of an endcap 24 with the magnets 26 on the fold portion 34 of the face panel 23 aligned with associated magnets 26 on the triangular portion 32 of the endcap 24. In the event that an operator misaligns one panel 11 with respect to the other, the magnets 26 will act to draw the panels—and their associate graphics—into correct alignment. FIG. 21 shows the face panel 23 attached to the endcap 24. In an embodiment with adhesive 28, the magnets 26 of the face panel 23 attract and engage the magnets 26 of the endcap 24 to draw the panels together, and the adhesive 28 holds the panels in place. FIG. 22 shows the system after attachment of a second endcap 24 in a similar manner. FIG. 23 shows the positioning of a second face panel 23 adjacent to the first and second endcaps 24, and FIG. 24 shows the completed freestanding system 10 with the face panels 23 and endcaps 24 secured to one another.

Throughout this description, directional terms, such as "vertical," "horizontal," "top," "bottom," "upper," "lower," "inner," "inwardly," "outer" and "outwardly," may be used to assist in describing the invention based on the orientation of the embodiments shown in the illustrations. The use of directional terms should not be interpreted to limit the invention to any specific orientation(s). The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. An upright display system comprising:

a face panel substrate and an end panel substrate, each having a front surface, a rear surface, an upper edge, a lower edge and a pair of opposing side edges, the substrates each defining a thickness between the front surface and the rear surface;

each of the substrates including first and second cutouts in the rear surface of the respective substrate, the cutouts extending from the upper edge to the lower edge to form a pair of hinges in the substrate, the first and second cutouts are spaced apart at about twice the thickness of the substrate, each of the cutouts dividing the substrate into a main substrate portion adjacent the second cutout, an intermediate portion between the cutouts, and a fold portion extending from the first cutout to a side edge of the substrate, the substrate folded about the hinges such that the rear surface of the fold portion abuts the rear surface of the main portion;

an adhesive between the rear surface of the fold portion and the rear surface of the main portion; and wherein the face panel substrate includes at least one magnet disposed on the front surface of the fold portion and wherein the end panel substrate includes at least one magnet disposed on the intermediate portion of the end panel substrate, the at least one magnet of the face panel substrate aligning and attracting the at least one magnet on the end panel substrate with the end panel substrate extending at an angle with the face panel substrate to enable the formation of a box-like configuration for the upright display system;

the substrates each including a magnet channel defined in the front surface, the at least one magnet of the face panel substrate disposed in the magnet channel of the face panel substrate, and the at least one magnet of the end panel substrate disposed in the magnet channel of the end panel substrate;

the substrates each including a printed graphic on the front surface, wherein the printed graphic of each of the substrates is registered with respect to the at least one magnet of that substrate whereby the printed graphics of the face panel substrate and the end panel substrate are correctly aligned to display a continuous image across the substrates.

2. The display panel of claim 1 including an adhesive disposed over the at least one magnet of at least one of the face panel substrate and the end panel substrate.

3. The display panel of claim 1 including a plurality of the magnets of the face panel substrate spaced apart in alignment along a length of the face panel substrate and a plurality of the magnets of the end panel substrate spaced apart along the length of the end panel substrate between the upper edge and the lower edge of the respective substrates.

4. The display panel of claim 3 wherein at least one of the face panel substrate and the end panel substrate is folded such that the front surface of the intermediate portion is perpendicular to the front surface of the main portion and the front surface of the fold portion.

5. The display panel of claim 4 wherein the rear surface of the fold portion lies flat against the rear surface of the main portion.

6. The display panel of claim 5 including an auxiliary magnet spaced from the at least one magnet between the pair of side edges for attaching to a second upright panel system.

7. The display panel of claim 6 including a corner brace extending between the rear surface of at least one of the face panel substrate and the end panel substrate, and the rear surface of the second substrate.

8. The display panel of claim 7 including a notch in the lower edge of at least one of the face panel substrate and the end panel substrate for receiving a cable.

9. An upright display system comprising:

a face panel substrate and an end panel substrate, each having a front surface, a rear surface, an upper edge, a lower edge and a pair of opposing side edges, the substrates each defining a thickness between the front surface and the rear surface;

each of the substrates including first and second V-shaped cutouts in the rear surface, the cutouts each converging from the rear surface to a point of the V-shape adjacent the front surface to form a pair of hinges in the substrate, the cutouts spaced apart such that the distance between the points of the respective V-shapes is about twice the thickness of the substrate, the cutouts extending parallel to each other from the upper edge to the lower edge, and dividing the substrate into a main substrate portion adjacent the second cutout, an intermediate portion between the cutouts, and a fold portion extending from the first cutout to a side edge of the substrate, the substrate folded about the hinges such that the rear surface of the fold portion lies flat against the rear surface of the main portion;

an adhesive between the fold portion and the main portion; and wherein the face panel substrate includes at least one magnet disposed on the front surface of the fold portion of the face panel substrate, and wherein the end panel substrate includes at least one magnet disposed on the intermediate portion of the end panel substrate aligning and attracting the at least one magnet on the face panel substrate with the end panel substrate extending at an angle with the face panel substrate to enable the formation of a box-like configuration for the upright display system when the face panel substrate and the end panel substrate are connected to a second one of the face panel substrate and a second one of the end panel substrate;

the substrates each including a printed graphic on the front surface, wherein the printed graphic of each of the substrates is registered with respect to the at least one magnet of that substrate whereby the printed graphics of the face panel substrate and the end panel substrate are correctly aligned to display a continuous image across the substrates, and an additional magnet disposed on the front surface of the main portion of at least one of the face panel substrate and the end panel substrate and capable of aligning and attracting an another associated magnet on another one of the box-like structures to form a series of connected box-like structures.

10. A method for constructing an upright, box-like graphic display structure comprising the steps of:

providing a face panel substrate having a front surface, a rear surface, a top edge, a bottom edge and a side edge, the front surface including a desired printed graphic material;

providing an endcap substrate having a front surface, a rear surface, a top edge, a bottom edge and a side edge, the front surface including a desired printed graphic material;

forming two V-shaped channels into the rear surfaces of each of the face panel substrate and the endcap substrate to create parallel hinges in the substrates, wherein in each of the substrates, the hinges defining a main substrate portion on a first side of the hinges, an intermediate portion between the hinges, and a fold portion on a second side of the hinges and including the side edge;

forming a magnet channel in the front surface of the face panel substrate within the fold portion;

forming a magnet channel in the front surface of the endcap substrate within the intermediate portion;

inserting a magnet into each magnet channel to sit flush with the front surface of the substrates;

applying an adhesive to the rear surface of one of the fold portion and the main portion of each of the substrates;

folding each of the substrates about the hinges such that the fold portion lies flat against the main panel with the adhesive in between;

standing the face panel substrate and the endcap substrate on a ground surface with the bottom edges of the substrates facing the ground surface;

aligning the magnet of the face panel substrate with the magnet of the endcap substrate, the face panel substrate extending at an angle with respect to the endcap substrate; and connecting the standing first and second substrates to one another via the magnets, to enable the formation of a box-like structure with the printed graphic material of the face panel substrate and printed graphic material of the endcap substrate correctly aligned to display a continuous image across the substrates.

* * * * *